United States Patent [19]

Hensley

[11] Patent Number: 4,610,080

[45] Date of Patent: Sep. 9, 1986

[54] METHOD FOR CONTROLLING FUEL INJECTOR LIFT

[75] Inventor: Thomas E. Hensley, Newport News, Va.

[73] Assignee: Allied Corporation, Morris Township, Morris County, N.J.

[21] Appl. No.: 760,026

[22] Filed: Jul. 29, 1985

[51] Int. Cl.[4] ..... H01F 7/06; B05B 1/30

[52] U.S. Cl. ..... 29/602 R; 60/740; 239/585; 251/129.1

[58] Field of Search ..... 29/602 R, 407, 157 R, 29/705, 707, 709, 720; 60/740; 239/585, 600; 251/429.1, 429.01, 429.03, 141

[56] References Cited

U.S. PATENT DOCUMENTS 3,785,029 1/1974 McClellan et al. ..... 29/157.1 R 4,421,278 12/1983 Kienzle et al. ..... 239/585

*Primary Examiner*—Howard N. Goldberg

*Assistant Examiner*—Irene Gozabi

*Attorney, Agent, or Firm*—Russel C. Wells; Markell Seitzman

[57] ABSTRACT

A method for controlling fuel injector lift control provides accurate lift dimensions over the life of the injector 10. The method can be implemented by sophisticated equipment for more automated operation but the steps of measuring and determining the spacing between the pole piece 18 and the armature member 26 and forming a spacer 12 as a result of such measurements, substantially follow the concept of differential gaging 36 and stepper motor 52 controlled press 38. Once a spacer 12 is sized, it is mated with the housing member 14 and the valve body assembly 24 and held in place by unitizing the injector 10.

3 Claims, 4 Drawing Figures

METHOD FOR CONTROLLING FUEL INJECTOR LIFT

FIELD OF INVENTION

This invention relates in general to a method for controlling fuel injector lift and more particularly to a low cost spacer and method for permanently establishing injector valve lift in production injectors.

BACKGROUND OF INVENTION

Most fuel injection systems, either single point or multipoint systems, use electromagnetic fuel injectors for controlling the flow of fuel into the engine. The amount of lift, the actual opening height of the valve, is directly proportional to the working air gap between the pole piece and the armature of the solenoid controlling the movement of the valve. The force of the solenoid is proportional to the square of the distance between the pole and the armature. The tolerance of the lift dimension of fuel injectors is plus or minus two ten thousandths of an inch (0.0002") (0.005 mm), therefore, very precise control of the working air gap of the solenoid is required.

One of the more common means of accurately setting the lift of an injector is the placement of a precision ground spacer between the injector housing assembly and the valve body assembly. The spacer thickness is determined by accurately measuring the armature and the pole piece relative to axially spaced and aligned surfaces. From a comparison of these two measurements and with the addition of the measurement representing the desired lift, a ground spacer is added at assembly.

This operation requires the stockpiling of several different sizes of pre-ground spacers to be available during the assembly of the injectors resulting in hand assembly of each of the injectors and the resultant highly labor intensive product.

SUMMARY OF INVENTION

It is an advantage of the present invention to control the lift of an injector by means of an automatic assembly process wherein each injector has a custom made lift control spacer. It is a further advantage to reduce the labor intensive cost of manufacturing fuel injectors.

These and other advantages result from a method for controlling fuel injector lift comprising the steps of determining the desired fuel injector valve lift (Lift). Forming a spacer having a first predetermined thickness that is substantially greater than the lift required. Then measuring the distance (Y) between the armature and a first surface on the housing containing the armature. Then measuring the distance (X) between the pole piece and a second surface on the housing containing the pole piece. The first and second surfaces are spaced apart and axially opposed in the finally assembled injector. Calculating the desired spacer thickness according to the following equation:

$$\text{Spacer thickness} = \text{Lift} + Y - X,$$

wherein said armature extends outwardly of said first surface. Using the calculation for positioning the anvils of a press at spaced distance equal to the calculated spacer thickness. Operating the press for reducing the first predetermined spacer thickness to the calculated spacer thickness; and then placing the spacer between said first and second surfaces.

The measuring of the mating parts of an injector assembly is by means of an automatic gaging machine to generate a dimension to be satisfied by means of the thickness of a ring placed between the mating parts during assembly. The mating parts are measured by differential gaging techniques and the difference amount is fed to a stepper motor controlling one shoe of a press. The shoes of the press are tapered wedges which function to limit the travel of the press. Mounted in the press in a fixed relationship to the shoes, are a pair of anvils between which the spacer to be deformed is positioned. The spacer in one embodiment is a deformable wire ring while in another embodiment may be a sintered metal ring. The stepper motor moves one of the shoes relative to the other a horizontal distance relative to the finished thickness of the spacer. Once the move is completed, the press actuates and the spacer on the anvils is compressed to the desired height. Once the spacer is at its desired thickness, it is removed from the press and subsequently placed between the mating parts and the parts are then assemblied as a finished injector.

DETAILED DESCRIPTION

Figure 1:
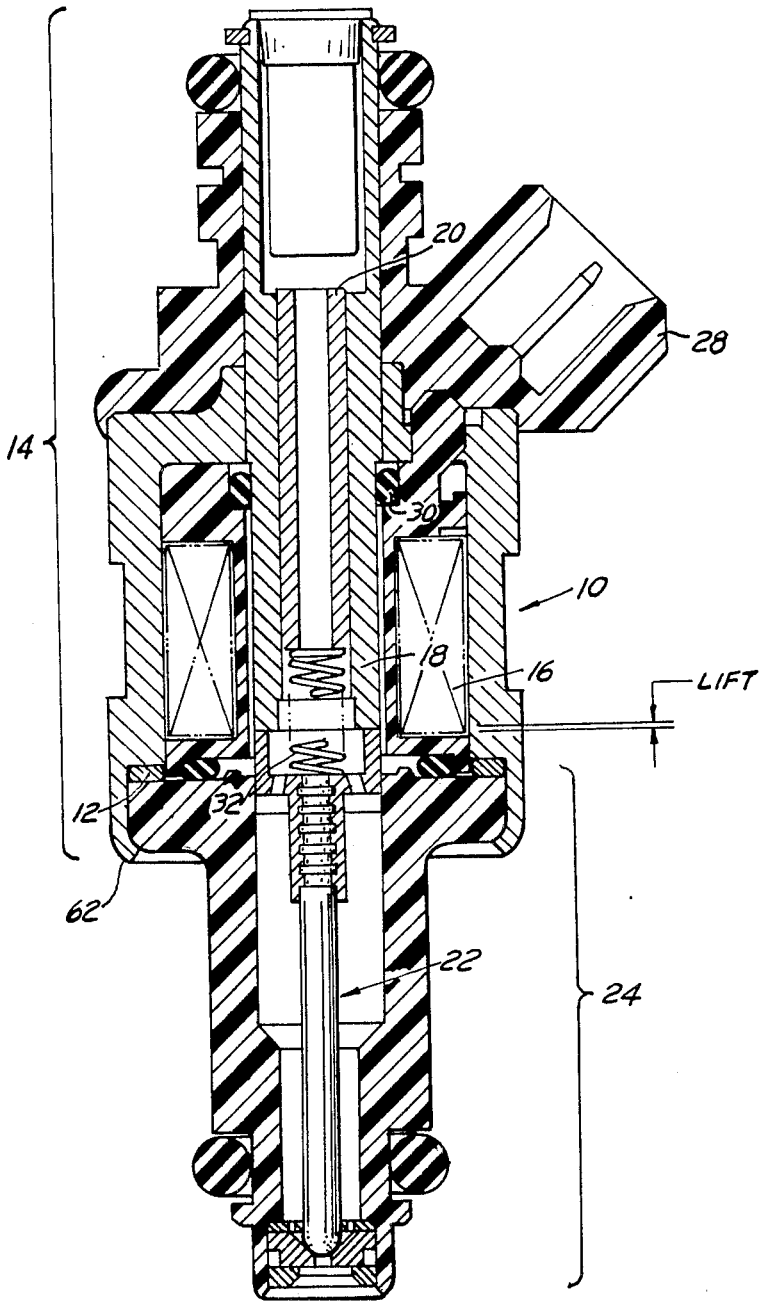
FIG. 1 is a sectional plan view of an injector illustrating the utilization of the spacer of the present invention.

FIG. 1 is an example of a top feed fuel injector 10 utilizing the spacer 12 of the present invention. The injector housing member 14 as shown in FIG. 3 contains the solenoid coil 16 and the pole piece 18 for the electromagnetic circuit. The pole piece 18 illustrated in FIG. 3, has an adjusting elongated tube 20 for the transporting of fuel the length of housing member 14 to the valve member 22 in the valve body assembly 24 of FIG. 2. The upper portion of the valve member 22 is the armature member 26 and it is the space between the pole piece 18 and the armature member 26 that defines the "Lift" of the injector 10.

Referring to FIG. 3, there is illustrated the injector housing member 14 comprising the pole piece 18, connector cap 28 and solenoid coil 16 along with some of the seals 30 used in the injector 10. As illustrated in FIG. 1, an adjusting elongated tube 20 is inserted in the pole piece 18. The adjusting elongated tube 20 has as one of its functions, to preload the bias spring 32.

Figure 2:
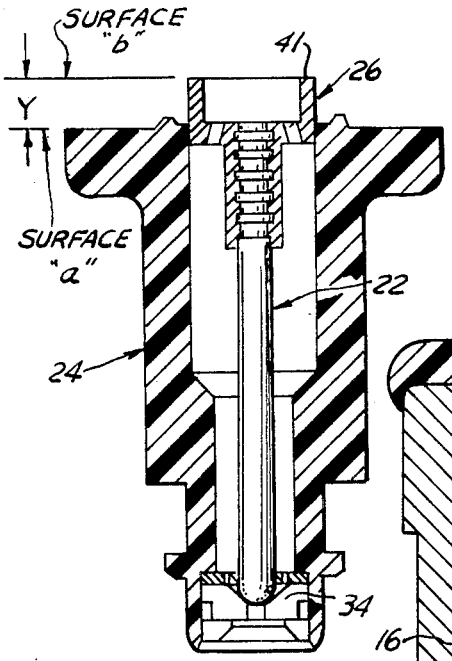
FIG. 2 is a sectional plan view of one of the mating parts of the injector illustrating the one of the measured dimensions.
Figure 3:
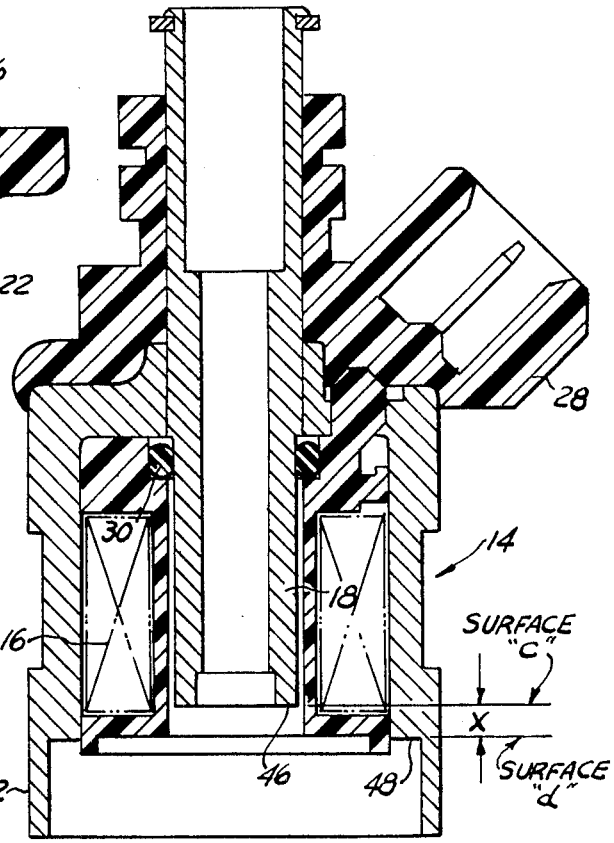
FIG. 3 is sectional plan view of another of the mating parts of the injector illustrating another of the measured dimensions.

The bias spring 32 bears against the valve member 22 to close the valve 34 in the valve body assembly 24 of FIG. 2.

The upper portion of the valve member 22 is an armature member 26 which is magnetically attracted to the pole piece 18 under the control of the solenoid coil 16. The lower portion of the valve member 22 functions to seal the valve 34 when in its biased position and to open the valve 34 when the armature member 26 is attracted to the pole piece 18. The amount of travel of the armature member 26 is the Lift of the injector 10. Lift is proportional to the amount of valve 34 opening. As such, Lift is a fixed amount or dimension for each injector 10.

Lift is a predetermined value that is designed into the injector 10 and as such has been set into the injector 10 at assembly by means of selection of properly ground spacer 12 placed between the pole piece 18 and the armature member 26. In prior art injectors, the Lift was set after the injector 10 was assembled by means of a threaded adjustment.

In the present invention, Lift is determined by means of differential gaging 36 and the results of such gaging are supplied to a controlled press 38 for deforming an annealed ring from a ring supply 40 to the proper size. The sized ring or spacer 12 is then automatically assembled with the housing member 14 and the valve body assembly 24 which were subject to the differential gaging 36.

Referring to FIGS. 2 and 3, the relationship between the measured dimensions, the spacer thickness and lift is as follows:

From FIG. 2 measure the distance "Y" between surface "a" and surface "b".

From FIG. 3 measure the distance "X" between surface "c" and surface "d". wherein:

surface "a" is a first surface 42 of the valve body assembly 24;

surface "b" is the surface 44 of the armature member 26;

surface "c" is the surface 46 of the pole piece 18;

surface "d" is a second surface 48 of the housing member 14;

and the first and second surfaces 42,48 are axially aligned opposing surfaces that are spaced apart in the magnetic circuit of the completed injector 10.

Figure 4:
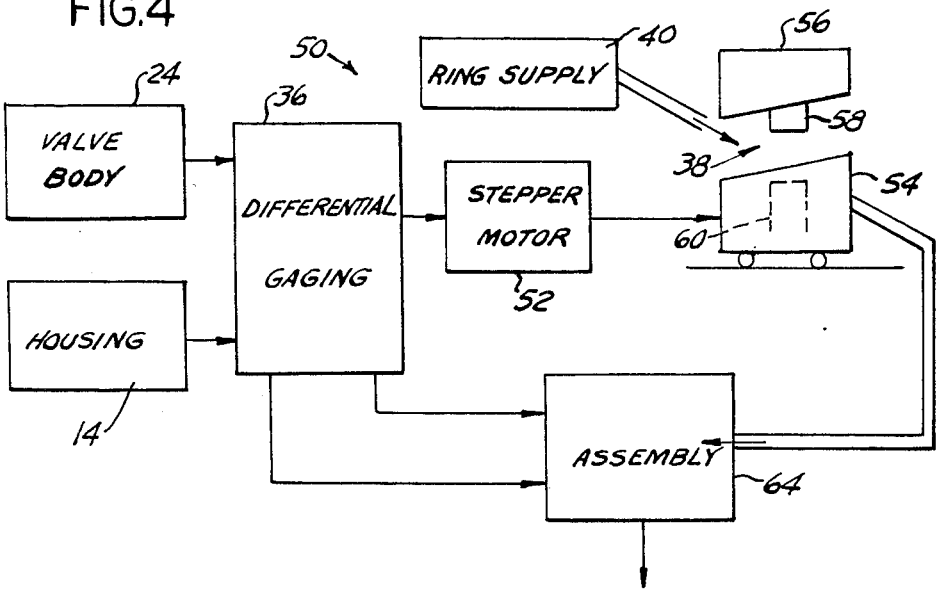
FIG. 4 is a schematic drawing of the process utilized in the practice of the invention.

Referring to FIG. 4, there is illustrated a schematic of the manufacturing system 50 for acomplishing the advantages of this invention. A housing member 14 and a valve body assembly 24 are individually gaged by differential gaging 36 to measure the "X" and "Y" dimensions. In accordance with the above equation (1), knowing the desired Lift, the spacer 12 thickness is determined. This valve is supplied to a stepper motor 52 to position the lower shoe 54 of the press 38. The shoes 54,56 cooperate to limit the travel of the anvils 58,60 of the press 38 and thereby control the thickness of the spacer 12. In the preferred embodiment, the shoes 54,56 are a pair of tapered stops which have a two degree (2°) taper. The degree of taper is a mere matter of design as it is a function of the desired amount of horizontal travel for a given amount of vertical spacing. The anvils 58,60 of the press 38 are nominally spaced apart and depending upon the relative position of the shoes 54,56, the thickness of the spacer 12 is determined.

The stepper motor 52, in response to the value of the differential gaging 36, will move the lower shoe 54 a linear distance proportional to the change in spacer 12 thickness from a nominal dimension. In the preferred embodiment, for each degree of taper, the spacer 12 thickness changes seventeen thousandths of an inch per inch (0.017") (0.43 mm) of travel of the lower shoe 54.

The spacer 12, in the preferred embodiment, is an annealed split wire ring. The spacer 12 is placed between the anvils 58,60 of the press 38. The housing member 14 and the valve body assembly 24 are measured and the results of the differential gaging 36 are supplied to the control for the stepper motor 52. The lower shoe 54 is positioned and the press 38 is operated. The mating of the tapered upper shoe 56 and the tapered lower shoe 54 limits the travel of the press anvils 58,60, thereby controlling the thickness of the spacer 12. The spacer 12 is then removed from the press 38 and inserted in the housing member 14 on the second surfaces 48. The valve body assembly 24 with the seal 30 is placed in the housing member 14 with the first surface 42 on the spacer 12. The housing member 14 and the valve body assemby 24 are placed together in a second press and brought together retaining the spacer 12 between and in contact with the first and second surfaces 42,48. A swedging tool then curls over the end 62 of the housing member 14 to hold the housing member 14 and the valve body assembly 24 together.

The spacer 12 may also be fabricated from a powered or sintered metal composition which is sized and then fired to harden. The hardened powered metal spacer is then placed between the housing member 14 and valve body assembly 24 abuting the first and second surfaces 42,48 and held in place as described above.

The completed injector 10 is then removed from the second press and moved to subsequent operations 64 for further assembly and calibrations. The result at this time is an injector that has a predetermined Lift that is held to a tolerance that will provide very accurate fuel quantity discharge when actuated.

There has thus been shown and described a method and article 12 for fuel injector lift control. The method can be implemented by more sophisicated equipment for more automated operation but the steps of measuring and determining the spacing between the pole piece 18 and the armature member 26 and forming the spacer 12 as a result of such measurements, will be substantially the same. Once a spacer 12 is sized, it is mated with the housing member 14 and the valve body assembly 24 and held in place.

What is claimed is:

1. A method for controlling fuel injector lift in an electromagnetic fuel injector by controlling the space between the armature in a valve body assembly and the pole piece in a housing member, comprising the steps of:

determining the desired fuel injector valve lift (Lift) for discharging a desired rate of fuel flow from the injector valve;

forming a spacer having a first predetermined thickness;

measuring the distance (Y) between the armature and a first surface in the valve body assembly;

measuring the distance (X) between the pole piece and a second surface in the housing member, wherein the first and second surfaces are axially aligned, spaced apart, opposed surfaces;

calculating the desired spacer thickness according to the following equation and generating an electrical signal proportional to said calculation:

$$\text{spacer thickness} = \text{Lift} + Y - X,$$

wherein the armature extends outwardly of the first surface and the pole piece extends inwardly of the second surface;

responding to said electrical signal for reducing the first predetermined spacer thickness to the calculated spacer thickness;

placing the spacer between the first and second surfaces; and then assembling the housing member, the valve body assembly and the spacer into an unitary fuel injector wherein the fuel injector valve lift is equal to the calculated spacer thickness.

2. A method for automatically assembling an electromagnetic fuel injector for controlling fuel injector lift having a valve body member with an armature member and a housing member with a pole piece member, comprising the steps of:

pairing together a valve body assembly and a housing member;

differential gaging two surfaces on each of the valve body assembly and the housing member, one surface of the valve body assembly being the armature and another surface being the pole piece member in the housing member and the remaining two surfaces being respectively on the valve body assembly and the housing member opposing each other;

generating an electrical signal indicating the differential distance between the opposing surface;

loading a deformable ring having a predetermined thickness in a press;

actuating an electric motor with the electrical signal to limit the movement of the press to the differential distance;

pressing the thickness of the deformable ring to the differential distance to form a spacer;

loading the paired valve body assembly and housing member into an assembly fixture;

automatically positioning the spacer between the opposing surfaces in the valve body assembly and the housing member and then assembling the valve body assembly, the housing member and the spacer into an unitary structure.

3. A system for automatically assembling an electromagnetic fuel injector with a predetermined injector lift wherein the injector comprises a valve body member having an armature therein controlling the valve opening and a housing member enclosing said valve body member, the housing member having a pole piece magnetically coupled to the armature, said system comprising:

differential gaging means for measuring a first distance between one end of the armature and a first surface on the valve body member, measuring a second distance between one end of the pole piece and a second surface on the housing member;

calculation means responsive to said first and second distances and the predetermined injector lift to generate an electrical signal;

press means having an upper and lower shoe means for limiting the stroke of said press means to control the final spacing of the punch and the die of said press means when operated;

stepper motor means responsive to said electrical signal and operable to position at least one of said shoes of said press means;

ring supply means having at least one ring having a thickness greater than the sum of said first and second distances, said ring supply means including means for positioning said at least one ring between said punch and die of said press means;

means for operating said press means compressing said at least one ring to a thickness equal to the final spacing of the punch and the die of said press means forming a spacer; and second press means receiving said valve body member, the housing member and said spacer between said first and second surfaces and operable for forming a unitary fuel injector.

* * * * *